United States Patent [19]

Pett et al.

[11] Patent Number: 4,887,731

[45] Date of Patent: Dec. 19, 1989

[54] SHIPPING CONTAINER

[75] Inventors: Bruce Pett, Fenelon Falls; David Wain, Cavan, both of Canada

[73] Assignee: Bonar Plastics Ltd., Lindsay, Canada

[21] Appl. No.: 278,747

[22] Filed: Dec. 2, 1988

[30] Foreign Application Priority Data

Dec. 8, 1987 [CA] Canada ..... 553740

[51] Int. Cl.[4] ..... B65D 7/00

[52] U.S. Cl. ..... 220/1.5; 220/69

[58] Field of Search ..... 220/1.5, 85 K, 69

[56] References Cited

U.S. PATENT DOCUMENTS

| | | | |
|---|---|---|---|
| 2,975,929 | 3/1961 | Sjoblom | 220/1.5 X |
| 3,623,631 | 11/1971 | Ford | 220/69 |
| 3,812,995 | 5/1974 | Lewis | 220/1.5 |
| 3,828,964 | 8/1974 | Bonnot | 220/1.5 |
| 3,828,965 | 8/1974 | Yarbrough | 220/1.5 |
| 3,968,895 | 7/1976 | Barnes, Jr. et al. | 220/1.5 |
| 4,157,609 | 6/1979 | Schutz | 220/1.5 X |
| 4,445,614 | 5/1984 | Mitsumori et al. | 206/599 |
| 4,742,933 | 5/1988 | Panick | 220/69 |
| 4,779,751 | 10/1988 | Munroe | 220/1.5 X |

FOREIGN PATENT DOCUMENTS

| | | |
|---|---|---|
| 560471 | 7/1958 | Canada . |
| 643984 | 7/1962 | Canada . |
| 659168 | 3/1963 | Canada . |
| 684598 | 4/1964 | Canada . |
| 796572 | 10/1968 | Canada . |
| 899255 | 5/1972 | Canada . |
| 936482 | 11/1973 | Canada . |
| 961784 | 1/1975 | Canada . |
| 1090724 | 2/1980 | Canada . |
| 1159379 | 7/1983 | Canada . |
| 1225045 | 4/1987 | Canada . |

*Primary Examiner*—Steven M. Pollard

*Attorney, Agent, or Firm*—Burns, Doane, Swecker & Mathis

[57] ABSTRACT

A transport container or shipping box comprises a rectangular base surrounding by upstanding walls and covered by a lid. The underside of the base is formed with recesses and pockets that open laterally for engagement by materials handling equipment such as a fork lift truck. The recesses and pockets are formed by removable feet that are detachably secured to the underside of the base by threaded fasteners, the threaded fasteners having enlarged heads that form support pads on the undersides of the feet.

16 Claims, 2 Drawing Sheets

SHIPPING CONTAINER

BACKGROUND OF THE INVENTION (a) Field of the Invention

This invention relates to improvements in shipping or transport containers such as shipping boxes.

(b) Description of the Prior Art

One form of transport container as widely used in the fishing industry for transporting fish comprises an integrally molded pallet with upstanding peripheral walls closed at the top by a detachable lid. The underside of the pallet is formed with integral feet that define longitudinal and transverse recesses and pockets designed to receive the tines of fork-lift trucks and similar materials handling equipment. Such transport containers are conveniently formed by the roto-molding process and have proved to be very useful. However such containers are sometimes subjected to rough handling and in almost all cases the base portion around the pockets or openings are damaged or pierced by the tines of the handling equipment, eventually rendering the container unserviceable.

SUMMARY OF THE INVENTION

The present invention provides a transport container comprising: a flat base bounded by four walls of uniform height, said base having a plurality of elongate feet detachably secured to the underside thereof one such foot being positioned adjacent and parallel to each of a pair of opposite side edges of the base, each said foot defining a pair of spaced elongate pocket openings adapted to receive tines of container-handling equipment, said feet being secured to the base by fastener means comprising a screw-threaded stem insertable through an aperture in said foot and engagable in a screw-threaded bore in said base, said fastener means having an enlarged flattened head adapted for engaging against the underside of a said foot and forming a pad for the support of the container.

To aid in locating the feet relative to the threaded bores in the underside of the base, the latter is preferably provided with downwardly tapering projecting bosses surrounding each bore, there being complementary recesses in the upper sides of each of the feet. There are preferably three elongate feet, one pair being adjacent opposed longitudinal edges of the container base, and the third being arranged medially therebetween. Preferably each foot is attached by three fasteners, the pad of the central fastener in each of the outer feet and the pads of the end fasteners in the central foot preferably being positioned at a slightly higher level than the remaining pads, so that the container is normally supported upon five pads, but includes four additional upwardly offset pads that may contact the support surface when the latter is uneven or when the container is deflected under load. The container is suitably of all plastic construction and the container box and feet may be of double walled roto-molded construction. Insulation, for example, foamed plastics may readily be provided between the double walls, if desired for the particular application for which the transport container is provided.

BRIEF DESCRIPTION OF THE DRAWINGS

The invention will further be described, by way of example only, with reference to the accompanying drawings, wherein.

DESCRIPTION OF THE PREFERRED EMBODIMENTS

Figure 1:
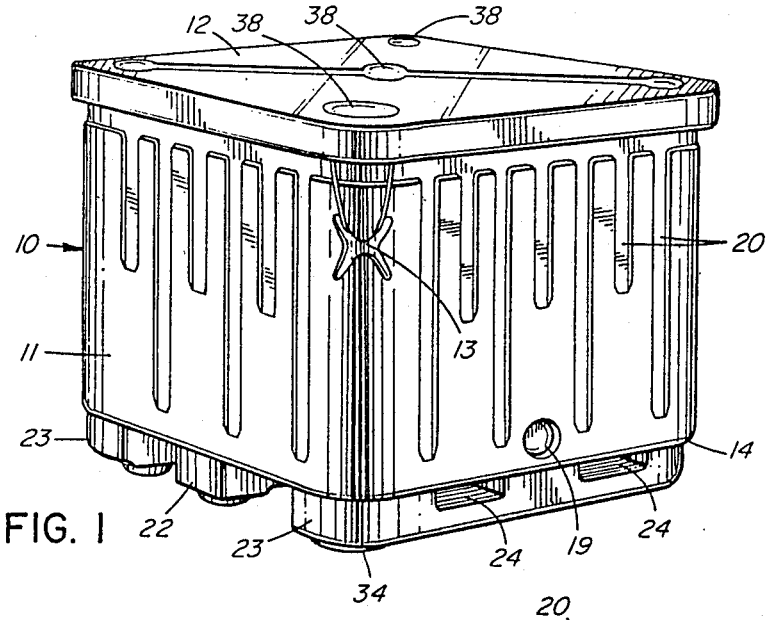
FIG. 1 is a perspective view of a transport container in accordance with the invention.
Figure 2:
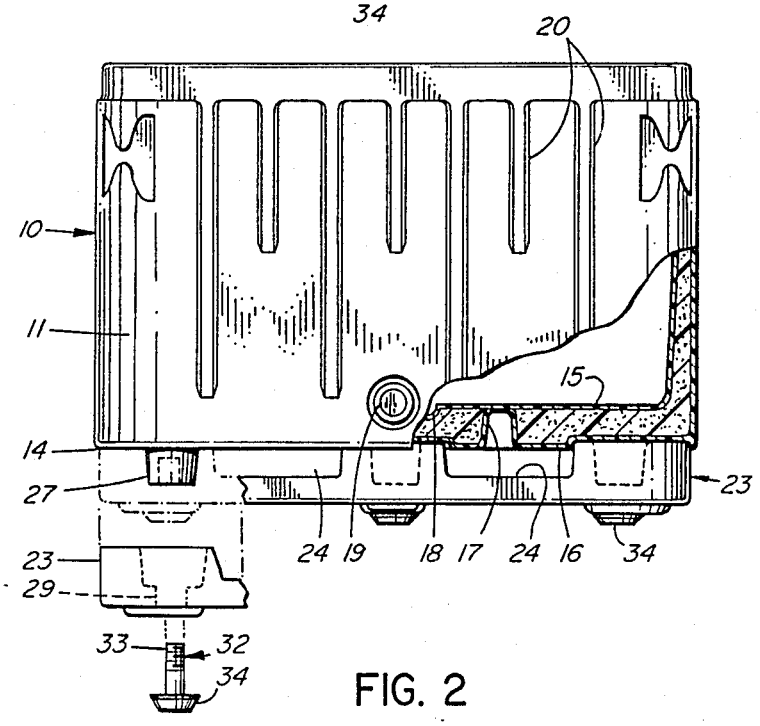
FIG. 2 is a side elevation of the transport container, partially fragmented.

As shown in FIG. 1, the transport container is provided in the form of an insulated fish box 10 comprising an upstanding peripheral wall 11 with rounded corners, the top of the box being closed by a rectangular lid 12 secured at each corner by corner clip tie-downs 13 attached to molded lugs provided on the outside corners of the box. Such boxes are usually provided in a range of sizes, e.g. with capacities of 9, 18, 24 and 35 cubic feet. Typical dimensions for a 24 cubic foot box would be 48 inches by 43 inches by 36.5 inches high. The boxes are designed to stack and to be picked-up and transported by conventional materials handling equipment such as fork-lift trucks. The box 10 is of plastic construction being of double-walled roto-molded configuration. The base 14 of the box is generally rectangular and consists of an inner panel 15 that is generally continuous with the inner panel of the peripheral wall 11 and spaced from an outer panel 16 that is continuous with the outer panel of peripheral wall 11, there being a plurality of spacers 17 molded in the outer panel 14 as seen in FIG. 2 and projecting close to the inner panel 15 to maintain separation between these two panels when the box is loaded. In the central area of the inner panel 15 there is a depressed well 18 which leads to a drain outlet 19 provided in one side of the peripheral wall 11. Similar spacers (not shown) may be provided if desired between the panels of the peripheral wall 11, and the latter is also strengthened by a series of molded ribs 20 provided in the outer panel thereof.

Figure 3:
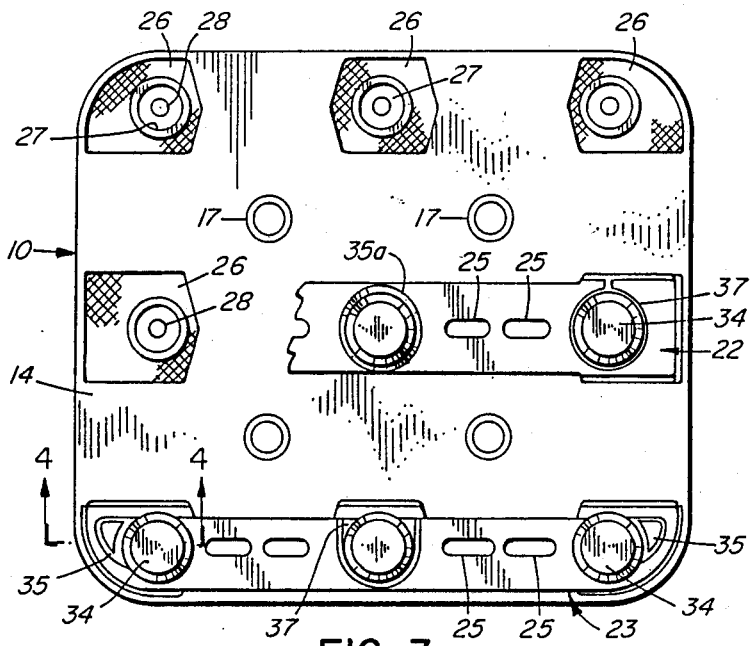
FIG. 3 is an underneath plan view of the transport container with portions removed to show hidden detail.

The box 10 is supported upon three detachable feet provided in the form of a central stringer 22 and two lateral stringers 23 extending length-wise of the base 14 as shown in FIGS. 2 and 3. Each lateral stringer is of elongate form and is positioned close to one edge of the base 14. The stringer 23 is of roto-molded construction and is formed on its upper side with a pair of large spaced rectangular recesses 24 which form pockets to receive the tines of a fork-lift truck or similar handling equipment. At intermediate locations in its length the lateral stringer 23 is formed with vertical stiffening slots 25 which serve to strengthen the structure. The ends of the stringer 23 on the laterally outerside are curved to follow the curvature of the rounded corners of the wall 11.

The construction of the central stringer 22 is similar to that of the lateral stringers 23, except that its ends are square. Each of the stringers 22 and 23 is attached to the base 11 at each end and in the mid-point of its length, these attachments being substantially identical, and one being illustrated in detail in FIG. 4. In the region of the attachment the outer panel 15 of the base is formed with a recessed area 26 formed with a rough-textured surface, there being a tapered cylindrical boss 27 projecting downwardly from within this area, the end of the boss defining a screw threaded blind bore 28. A corresponding bore 29 opens from the underside of the stringer 22, 23 and expands through a radial shoulder 30 into an enlarged tapered counterbore 31.

Figure 4:
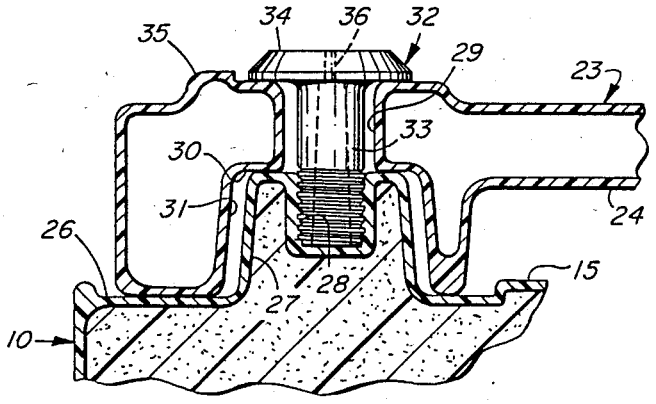
FIG. 4 is a sectional view taken on the line 4—4 of FIG. 3.

To attach the stringer or foot, it is placed with each counterbore 31 positioned around a tapered boss 27 as seen in FIG. 4, the shoulder 31 in this case resting against the end surface of the boss 27. The upper surface of the stringer 22, 23 surrounding the counterbore 31 is of rough-textured configuration and is in engagement with roughened recessed area 26 surrounding the boss.

Each stringer 22, 23 is in this position secured to the base 14 by three identical fasteners in the form of capscrews 32. As seen in FIG. 4, each capscrew 32 has a screw-threaded stem 33 that can be engaged in the threaded bore 28 and an enlarged disc-shaped head 34 the rim of which is beveled, and the shoulder of which engages on a downwardly offset region 35 of the undersurface of the stringer. The capscrew 32 is conveniently of a molded plastic construction and is provided with a slot 36 or the like for engagement by a tool by means of which it can be rotated to attach it or remove it from the base.

As will be evident, pad 34 of the capscrew projects downwardly beyond the bottom region of the stringers and constitutes a load-bearing pad which supports the container on a flat horizontal surface. The pads formed by the heads 34 of the fasteners are not however all at the same level. The end pads 34 of the lateral stringers 23 and the middle pad of the central stringer 22 are coplanar. The remaining four pads (i.e. the center pad on the lateral stringers and the end pads of the central stringer) are also coplanar but are positioned at a level slightly higher than the level of the other five pads, as is evident from FIG. 2, these four pads being positioned in slight recesses 37 (see FIG. 3) in the respective springer. Thus in normal operation the box will be supported upon the five pads 34 that are located at the four corners and at the center. The remaining four pads 34 will contact the supporting surface only when the latter is uneven, or when the base 14 of the box is deflected under heavy loading conditions.

To ensure that the stringers 22, 23 remain securely attached to the box 10 even after extended service and wear of the five lowermost of the pads 34, means are provided to protect these pads from being completely worn away. Such means comprises a downwardly projecting shoulder 35 (FIG. 4) positioned on the underside of the stringer 23 adjacent each of the corner pads 34. It will be appreciated that before the thickness of the pad 34 becomes completely worn away the shoulder 35 will come into engagement with the supporting surface and will help to protect the adjacent pad from further wear. Suitably the central pad of the middle stringer 22 is protected by a surrounding downwardly projecting shoulder 35*a*.

The boxes are designed to be stackable, and to this end, the lids 12 is provided with five circular depressions 38 arranged at the four corners and the center respectively thereof to receive the five lowermost of the pads 34. Even in the absence of the lid 12, the boxes 10 are stackable, in this case the bottom regions 35 surrounding the end pads of the outer stringers locating within the rim formed by the upper edge of the peripheral wall 11.

It is possible that in use water could pass between the top of the stringer and the bottom of the box and into the counterbore 31 and bore 29. Such water might well be contaminated, e.g. with fish offal, and should not be allowed to accumulate in these regions since they would be unhygenic and perhaps malodorous. To avoid this problem the stringers are provided with molded-in channels (not shown) to drain liquid from the bore 29 and counterbore 31.

The container or fish box 10 as described above has a number of advantageous. By making the feet 22, 23 detachable, it becomes possible to replace individual feet when these are damages e.g. by being pierced by the tines of a fork-lift truck or the like. Hitherto, such damage could render the box completely unserviceable so that the entire structure would have to be scrapped and replaced. With the improved construction of the present invention, a damaged foot can be replaced at very much reduced cost. Furthermore individual capscrews 32 can readily be replaced when the heads thereof become worn or otherwise damaged or unserviceable.

With the improved construction the fabrication of the box is simplified. Simpler and cheaper molds can be employed, and because of the two part construction the molding process is facilitated. A further advantage is that it now becomes possible to mold the body of the box and the feet in different materials. Not only the material but also the color of the feet can be varied as desired, and this makes it possible to employ coloured coding to identify the boxes for various purposes, e.g. according to application, contents, customer, destination, and the like. Shipping costs for the box can be reduced since by removing the feet 22, 23 and stowing them within the box, the effective volume of the box for shipping purposes is reduced.

The dimensions of the box are designed in such a manner that is possible to place one box, on its side, inside another and by placing a third box, upside down, on top of these two, one can ship 3 boxes in cubic space of 2, for a 33% freight savings. The dimensions that are significant are the shortest outside dimension which fits inside the largest inside dimension of the box. When the box is placed inside the other box, it is on its side with the short outside dimension inside of the long inside dimension of the other box. Therefore the long outside dimension is sticking up. This dimension, in turn, is one-half (or less) of the short inside dimension of the box. Therefore, the part of the inner box that projects out, above the outer box, is completely covered by the third box, (turned upside down), in a similar fashion as the lower box. The package then looks like two boxes, one upside down on top of the other, with a third box inside.

We claim:

1. A transport container comprising: a flat base bounded by four walls of uniform height, said base having a plurality of elongate feet detachably secured to the underside thereof one such foot being positioned adjacent and parallel to each of a pair of opposite side edges of the base, each said foot defining a pair of spaced elongate pocket openings adapted to receive tines of container-handling equipment, said feet being secured to the base by fastener means comprising a screw-threaded stem insertable through an aperture in said foot and engagable in a screw-threaded bore in said base, said fastener means having an enlarged flattened head adapted for engaging against the underside of a said foot and forming a pad for the support of the container.

2. A transport container according to claim 1 including locating means interacting between said base and said foot to position the latter with the apertures thereof in alignment with screw-threaded bores in the base.

3. A transport container according to claim 2 wherein said alignment means comprises a plurality of tapered bosses projecting downwardly from said base each surrounding one said screw-threaded bore and received in a complementary recess in said foot in the region of each said aperture.

4. A transport container according to claim 3 wherein a third foot positioned approximately mid-way between the two first mentioned feet, and each foot has associated therewith three fastener means arranged at its end and mid-point respectively, the heads of the fastener means at the four corners at the center of the base being coplanar, and the heads of the remaining four fasteners being spaced slightly above said plane.

5. A transport container according to claim 2, wherein said pockets are formed as recesses in the upper side of said feet, the upper side of each pocket being bounded by the underside of the base, and wherein a third foot is positioned approximately mid-way between the two first mentioned feet.

6. A transport container according to claim 2 of double-walled roto-molded construction said container having rounded corners and feet that are recessed slightly from the edges of the base and rounded at the ends to conform to the curvature of said rounded corners.

7. A transport container according to claim 2, wherein the base and four walls constitute an integrally formed plastics molding, the base and the four walls each being of spaced two panel construction, the space between the panels of the walls and base being filled with insulating material, said feet and fastening means also being of molded plastics construction.

8. A transport container according to claim 2 including a lid adapted to sit on the upper edges of the four walls, said lid having on its upper side a plurality of depressions corresponding in position to the positions of said fastener means to receive the flattened heads thereof and locate two such transport when arranged in stacked configuration.

9. A transport container according to claim 1, wherein a third foot is positioned approximately mid-way between the two first mentioned feet.

10. A transport container according to claim 1, wherein said pockets are formed as recesses in the upper side of said feet, the upper side of each pocket being bounded by the underside of the base.

11. A transport container according to claim 1, of double-walled roto-molded construction said container having rounded corners and feet that are recessed slightly from the edges of the base and rounded at that ends to conform to the curvature of said rounded corners.

12. A transport container according to claim 1, wherein the base and four walls constitute an integrally formed plastics molding, the base and the four walls each being of spaced two panel construction.

13. A transport container according to claim 1, wherein the base and four walls constitute an integrally formed plastics molding, the base and the four walls each being of spaced two panel construction, the space between the panels of the walls and base being filled with insulating material.

14. A transport container according to claim 1, wherein the base and four walls constitute an integrally formed plastics molding, the base and the four walls each being of spaced two panel construction, the space between the panels of the walls and base being filled with insulating material, said feet and fastening means also being of molded plastics construction.

15. A transport container according to claim 1, including a lid adapted to sit on the upper edges of the four walls, said lid having on its upper side a plurality of depressions corresponding in position to the positions of said fastener means to receive the flattened heads thereof and locate two such transport when arranged in stacked configuration.

16. A transport container according to claim 1, wherein a third foot positioned approximately mid-way between the two first mentioned feet, and each foot has associated therewith three fastener means arranged at its end and mid-point respectively, the heads of the fastener means at the four corners at the center of the base being coplanar, and the heads of the remaining four fasteners being spaced slightly above said plane.

* * * * *